US007985104B2

(12) United States Patent
Jäger et al.

(10) Patent No.: US 7,985,104 B2
(45) Date of Patent: Jul. 26, 2011

(54) SHIELD SLEEVE FOR A PLUG CONNECTOR

(75) Inventors: Werner Jäger, Hohenems (AT); Rudolf Fekonja, München (DE)

(73) Assignee: Hirschmann Automotive GmbH, Rankweil, Brederis (AT)

( * ) Notice: Subject to any disclaimer, the term of this patent is extended or adjusted under 35 U.S.C. 154(b) by 0 days.

(21) Appl. No.: 12/165,767

(22) Filed: Jul. 1, 2008

(65) Prior Publication Data

US 2009/0170366 A1 Jul. 2, 2009

(51) Int. Cl.
*H01R 13/434* (2006.01)

(52) U.S. Cl. ..... 439/748; 439/852

(58) Field of Classification Search ..... 439/271, 439/585, 595, 752.5, 842, 851, 852, 884, 439/745, 746, 748
See application file for complete search history.

(56) References Cited

U.S. PATENT DOCUMENTS

| | | | | |
|---|---|---|---|---|
| 4,030,804 | A * | 6/1977 | Enomoto | 439/884 |
| 5,266,056 | A * | 11/1993 | Baderschneider et al. | 439/745 |
| 5,511,987 | A * | 4/1996 | Shinchi | 439/205 |
| 5,520,548 | A * | 5/1996 | Hotea et al. | 439/358 |
| 5,695,368 | A * | 12/1997 | Joly et al. | 439/748 |
| 5,730,625 | A * | 3/1998 | Sikora | 439/595 |
| 6,183,312 | B1 * | 2/2001 | Yamamoto | 439/748 |
| 6,679,738 | B2 * | 1/2004 | Nimura | 439/852 |
| 7,338,313 | B2 | 3/2008 | Fekonja | 439/495 |
| 2007/0173102 | A1 | 7/2007 | Fekonia | 439/398 |

FOREIGN PATENT DOCUMENTS

| | | |
|---|---|---|
| DE | 102006014086 | 9/2007 |
| DE | 102006060238 | 6/2008 |

* cited by examiner

*Primary Examiner* — Thanh-Tam T Le
(74) *Attorney, Agent, or Firm* — Andrew Wilford

(57) ABSTRACT

The socket contact (1) for receiving a plug contact (10), the socket contact (1) having a contact casing (4) mounted on one end of a cable (2), the contact casing being contacted to an electrical conductor (3) of the cable (2), wherein according to the invention a biasing spring (5) is provided, wherein according to the invention the biasing spring (5) is designed such that it acts on the contact casing (4) and acts through at least one section of the contact casing (4) on the plug contact (10), and is attached at a first joint (6) to the contact casing (4), wherein furthermore the electrical conductor (3) is attached to the contact casing (4) at another joint (7) spaced from the first joint (6).

5 Claims, 1 Drawing Sheet

SHIELD SLEEVE FOR A PLUG CONNECTOR

FIELD OF THE INVENTION

The invention relates to a socket contact for receiving a plug contact, and to a method for producing this type of socket contact and attaching it to a cable.

BACKGROUND OF THE INVENTION

Plug connectors of this type that relate in particular to contact-free contacting systems are disclosed, for example, in DE 10 2006 002 774 [US 2007/0173102], DE 10 2005 014 158, DE 10 2006 060 238 [U.S. Pat. No. 7,338,313], or DE 10 2008 104 086.

Plug connectors that have, for example, one socket contact on the connector sleeve side and one plug contact on the plug side are well-known. Here the socket contact on the connector sleeve side is designed to be brought into effective connection with a plug contact of the plug, e.g. in the form of a contact pin.

OBJECT OF THE INVENTION

The problem to be solved by the invention is therefore to provide a socket contact for receiving a plug contact, as well as a method for producing this type of socket contact and attaching it to a cable, the socket contact being able of being produced quickly and efficiently in large quantities while having a simplified method of production and achieving the requisite socket contact reliability over its service life.

SUMMARY OF THE INVENTION

According to the invention, the problem is solved by an system where a biasing spring is provided that is designed such that it acts on the contact casing and through at least one section of the contact casing on the plug contact, and is joined at a first joint to the contact casing, and where furthermore the electrical conductor is joined to the contact casing at another joint spaced from the first joint.

The two spaced joints, where the spacing can measure only a few millimeters, enable both the biasing spring and the electric conductor to be joined to the contact casing either in the same production operation or it is also possible in an alternative approach first to join the biasing spring to the contact casing, then in another operation to join the electric conductor to the contact casing (or in reverse sequence). It is thus, for example, possible for one and the same manufacturer to produce both the socket contact, specifically, the contact casing, and in the same operation or two successive operations to join the biasing spring to the contact casing, while also performing the contacting (joining) of the electrical conductor to the contact casing. Alternatively, it is also possible, and this is frequently the rule, for the first manufacturer to produce the contact casing and attach the biasing spring, then to deliver this component to another manufacturer (assembler) who then joins the appropriately prepared cable with its electrical conductors to the contact casing. This procedure makes its possible to produce socket contacts that are mounted on the ends of cables in a fast and efficient manner. The two separate, i.e. spaced, joints furthermore have the advantage that both the joints as well as the joining process can be adapted to the materials and material thicknesses to be attached. What is furthermore advantageous here is that depending on the material combinations used (contact casing and biasing spring, or contact casing and electrical conductor) the joining processes can be matched appropriately to the specific material combinations. With respect to the joining processes, which can be the same or different for the two joints, welding or soldering processes are preferably considered, although other joining processes are also conceivable depending on material or material thickness.

In a development of the invention, the two joints are located on the same side face of the contact casing. This enables the contact casing, for example, after it is produced, to be inserted into a retainer, and for the two joints to be accessible from the same side, either for the same manufacturer, or sequentially for different manufacturers, with the result that both the biasing spring and the cable with a stripped electrical conductor are accessible from the same side (e.g. from the top), which aspects significantly facilitate feeding these components to the contact casing. This advantageously eliminates the need associated with an elongated contact casing for axially feeding the biasing spring and/or the electrical conductor, thereby avoiding difficulties in positioning these components in an automated production process and also avoiding associated preparations (such as for example bending the electrical conductor before it is attached to the contact casing).

BRIEF DESCRIPTION OF THE DRAWING

Additional embodiments of the invention are described in the dependent claims and are explained in more detail below with reference to the figures, although the invention is not limited to the embodiment illustrated. In the drawing:

SPECIFIC DESCRIPTION

Figure 1:
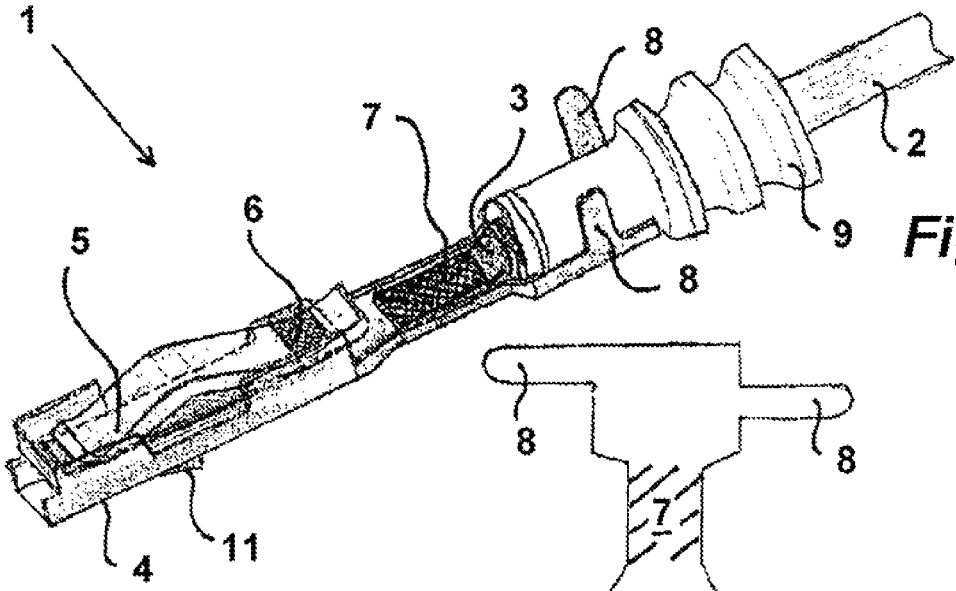
FIG. 1 is a perspective view of the plug connector according to the invention.
Figure 3:
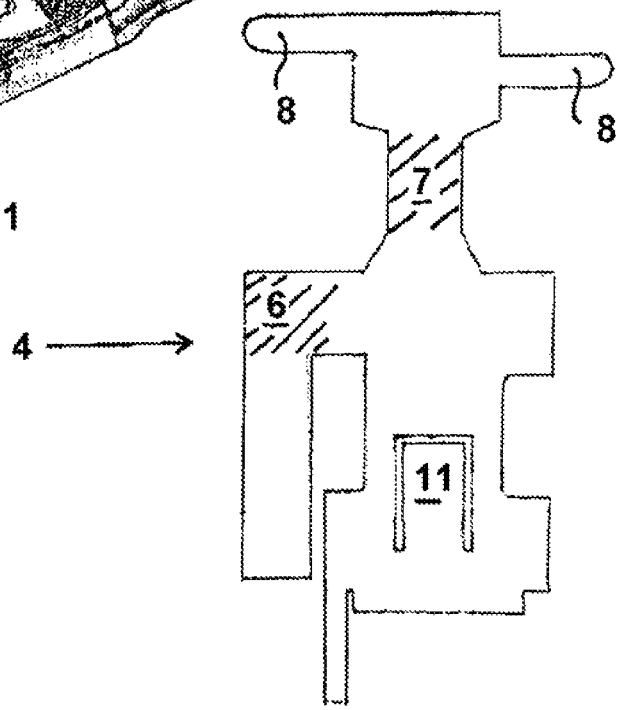
FIG. 3 is a developed view of the blank from which the connector sleeve is stamped.
Figure 2:
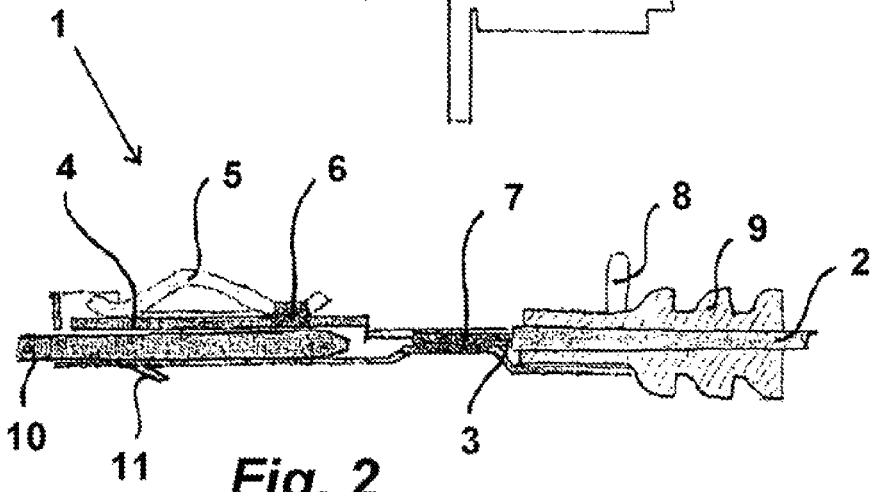
FIG. 2 is a longitudinal section through the connector.

FIGS. 1 and 3 show, to the extent details are visible, a three-dimensional view (FIG. 1) and a section (FIG. 2) through a socket contact 1 for receiving a plug contact 10, the socket contact 1 being mounted on the end of a cable 2 along with an outer sleeve, not specifically identified, the cable 2 furthermore having an electrical conductor 3. A contact casing 4 is mounted on the end of this cable 2, this contact casing 4 being advantageously designed as a connector box sleeve formed by stamping and bending. This stamped-bent part is illustrated in a developed view in FIG. 3. The connector box sleeve is produced as the contact casing 4, as shown in FIG. 1, by appropriately stamping it out of sheet metal, for example, with the shape shown in FIG. 3, then bending it. This contact casing 4 in the form of a connector box sleeve composed of an electrically conductive material holds the plug contact 10 and a biasing spring 5 to enhance the contact force and to ensure permanent contact when the plug contact 10 is inserted in the contact casing 4, this spring 5 in the embodiment of FIGS. 1 and 2 being elongated and having a roughly undulating shape. In a first production step, this biasing spring 5 is joined by its end section at a first joint 6 of the contact casing 4 to this casing, where in this case the electrical conductor 3 of the cable 2 has not yet been attached to the contact casing 4. Joining of the electrical conductor 3 at a second joint 7 of the contact casing 4 is effected either by the same manufacturer in a second operation, or in a second operation by another manufacturer. Alternatively, it is also possible for the electrical conductor 3 to be attached at the joint 7 in a first operation, and the biasing spring 5 to then be attached at the joint 6 to the contact casing 4 in another operation. In another alternative embodiment, it is also conceivable for both the biasing spring 5 and the electrical is conductor 3 to be attached to the contact casing 4 in one and the same operation.

In order to achieve the best possible contact reliability that in particular is not degraded by moisture and particles of contamination, the contact casing 4 has at least one, preferably two, crimping vanes B in the end section of cable 2 located there, which vanes close around the jacket of cable 2. This also provides strain relief for pulling or compressive forces acting on the socket contact 1.

As a rule, the socket contact 1 mounted on the cable 2 is also inserted into an outer casing, not shown, such that is it is advantageous that not only the jacket of the cable 2 but also a seal 9 mounted on the jacket of cable 2 is wrapped around and fixed there with crimping vanes 8, with the seal 9 sealing the socket contact 1 outwardly against the outer casing such that longitudinal water tightness is ensured.

The plug contact 10 is, for example, designed as a contact pin. Finally, reference 11 indicates a spring tab that projects from the contact casing 4 and engages a corresponding recess or a corresponding stop in the outer casing of the plug connector formed thereby, or rests against it so as to effect a primary interlock. This primary interlock in a manner known per se causes the socket contact 1 to be fixed in the outer casing that can be made of plastic using an injection-molding process.

The production process according to the invention is distinguished by the following steps:

The biasing spring 5 is attached to the contact casing 4 at the joint 6;

The electrical conductor 3 is attached to the contact casing 4 at another joint 7 spaced from the first joint 6.

Provision is furthermore made whereby joining of the biasing spring 5 to the contact casing 4 and joining of the electrical conductor 3 to the contact casing 4 are effected in one and the same operation, or in two successive operations.

Provision is furthermore made whereby in the event the electrical conductor 3 is a circular conductor the end of the electrical conductor 3 is plated before joining to the contact casing. This plating of the electrical conductor 3 before joining to the contact casing 4 can be eliminated if the joining process is designed such that the joining process then causes the previously round electrical conductor 3 (e.g. a stranded conductor) to be flattened such that the end of electrical conductor 3 is flattened in any case in the region of second joint 7 after the joining process to achieve a compact construction. The procedure of flattening the electrical conductor 3 can be eliminated if the cable 2 is a ribbon cable and the electrical conductor 3 is a corresponding flat conductor. Finally, provision is made whereby the seal 9 is pushed onto the jacket of cable 2 and is fixed by the crimping vanes 8 before the electrical conductor 3 is attached at the second joint 7 to the contact casing 4. It must be noted here that crimping by means of the crimping vanes 8 does not effect any electrical contacting, but instead this action simply causes the cable 2 to be mechanically fixed to the contact casing 4, preferably with the interposition of the seal 9. The joining of the biasing spring 5 to the contact casing 4 as well as the joining of electrical conductor 3 to the contact casing 4 is effected, as explained above, by joining processes such as welding or soldering, and not by a crimping action.

A significant aspect in terms of the function of the completed plug connector is that a force is exerted on the biasing spring 5 to act through the biasing spring 5 and the contact casing 4 on the plug contact 10. This brings about an enhanced pressing force between the electrical conducting parts of the plug connector and mating connector that are to be brought into contact with each other—specifically, the contact casing 4 of the plug connector with the plug contact 10 of the mating connector. This force is applied during the assembly of plug connector and mating connector, or subsequently thereto, where the casing and additional elements of the plug connector and the mating connector are designed such that the force is applied during the action of sliding them together. This can be, for example, a slider that is actuated and acts on the biasing spring 5 after the plug connector and mating connector have been completely slid together. However, the plug connector and mating connector can also be designed such that they are first slid together a certain distance, and a projection or the like then actuates the biasing spring 5 once the plug connector and mating connector have been slid together up to their end position. What is particularly advantageous here is that plug contact 10 is first inserted (plugged into) the contact casing 4 virtually without any friction and thus without any expenditure of force, and the contacting force (force from outside, pressing force) is applied through the biasing spring 5, as described above, once the plug contact 10 is in its end position within the contact casing 4.

The invention claimed is:

1. In combination with plug contact and with a cable having an electrical conductor and an insulating jacket, a socket contact comprising:

a longitudinally elongated conductive casing unitarily formed with one sleeve end dimensioned to receive the plug contact, an opposite end, and a side face;

a biasing spring;

a first weld or solder joint securing the biasing spring to the side face adjacent the one sleeve end such that the biasing spring bears through the sleeve end on the plug contact received therein; and a second weld or solder joint spaced longitudinally from the first joint and fixing and electrically connecting the electrical conductor to the side face of the casing at a spacing from the first joint.

2. The socket contact according to claim 1 wherein the casing sleeve is formed with two crimping vanes that close around the jacket of the cable.

3. The socket contact according to claim 2 wherein the crimping vanes fix a seal mounted on the jacket of the cable.

4. The socket contact according to claim 1 wherein the electrical conductor is plated at the second joint.

5. The socket contact according to claim 1 wherein the contact casing is a connector box sleeve and is a stamped-bent part.

* * * * *